US006742434B1

(12) United States Patent
Dillon

(10) Patent No.: US 6,742,434 B1
(45) Date of Patent: Jun. 1, 2004

(54) MACHINE GUN

(76) Inventor: Michael J. Dillon, 8009 E. Dillon's Way, Scottsdale, AZ (US) 85260-1809

( * ) Notice: Subject to any disclaimer, the term of this patent is extended or adjusted under 35 U.S.C. 154(b) by 0 days.

(21) Appl. No.: 10/387,954

(22) Filed: Mar. 13, 2003

(51) Int. Cl.[7] ..... F41F 1/10
(52) U.S. Cl. ..... 89/12; 42/16
(58) Field of Search ..... 42/16; 89/9–13.1, 89/1.41, 126

(56) References Cited

U.S. PATENT DOCUMENTS 125,563 A * 4/1872 Gatling ..... 89/12
3,595,128 A * 7/1971 Hoyt, Jr. ..... 89/12
3,611,866 A * 10/1971 Jacolucci et al. ..... 89/12
3,766,821 A * 10/1973 Cozzy et al. ..... 89/12
4,314,501 A * 2/1982 Kirkpatrick et al. ..... 89/12
4,329,907 A * 5/1982 Kirkpatrick et al. ..... 89/12
4,494,439 A * 1/1985 Sawyer ..... 89/12
4,841,835 A * 6/1989 Bohler et al. ..... 89/12

* cited by examiner

*Primary Examiner*—Michael J. Carone
*Assistant Examiner*—Troy Chambers
(74) *Attorney, Agent, or Firm*—William E. Hein

(57) ABSTRACT

A machine gun incorporates an additional helical cam assembly to reduce asymmetrical loads imposed on the bolt head and bolt body. Bearing pads positioned on the bolt head serve to support the bolt head within the chamber area of the forward portion of the rotor to thereby improve the accuracy and consistency of firing pin strikes against the primer, resulting in improved cartridge detonation.

4 Claims, 6 Drawing Sheets

MACHINE GUN

BACKGROUND AND SUMMARY OF THE INVENTION

This invention relates generally to Gatling machine guns and, more specifically, to the class of such guns known as 7.62 miniguns and improvements therein that serve to significantly improve their operational reliability.

The 7.62 minigun is a six-barreled, electric-driven machine gun originally designed and built by General Electric Company in the mid 1960's for the U.S. military. This gun has been in use since its inception by both the U.S. and foreign military forces, as well. Compared to other small caliber machine guns, the 7.62 minigun is complicated and, under operational conditions, often unreliable.

The 7.62 minigun fires a conventional 7.62 NATO cartridge that includes a bullet, a cylindrical cartridge case, a primer, and powder. The bullet is seated in the open end of the cartridge case; the primer is seated in the center of the base of the cartridge opposite the bullet; and the powder is located inside the cartridge case between the bullet and the primer. The cartridge is fired conventionally by first detonating the primer, which ignites the powder and, in turn, causes pressure within the cartridge case to increase to the point that the bullet is forced out of the cartridge case and down the barrel of the gun.

Cartridges are handled within the gun by six bolt assemblies, one for each of the six barrels. Each of the six bolt assemblies is aligned with a respective one of the six barrels. The six bolt assemblies are attached to and surround a main rotary body known as the rotor. The rotor is the core axis of the gun. The six barrels are connected to the forward portion of the rotor and are arranged for rotation as a cluster about a common axis, coincident with that of the rotor.

The bolt assembly is a mechanism that inserts a loaded cartridge into the barrel chamber and removes the empty cartridge after firing The bolt assembly is generally cylindrical in shape and includes a bolt head, a bolt body, and a spring-loaded firing pin as major components. The bolt head serves to retain the cartridge, while the bolt body houses the firing pin, which extends from the bolt body through the bolt head to provide a common longitudinal axis for both. A single off-center male helical cam extends from the bolt head rearward toward the bolt body, along and around the longitudinal axis of the bolt assembly. The male helical cam terminates in a corresponding groove termed a female helical cam. The male helical cam, in combination with the female helical cam, constitute a helical cam system. During operation of the gun, the bolt head and the bolt body are compressed together along the central axis created by the firing pin. During this process, the firing pin spring is compressed. As the bolt head and bolt body are compressed, the helical cam system forces the bolt head to rotate. At a predetermined point of rotation, a latching mechanism releases the spring-loaded firing pin, allowing it to strike the primer.

It is not uncommon for the male helical cam to break during use, causing the gun to severely jam. As a result of the use of only one helical cam system that is not aligned with the longitudinal forces of the cylindrical bolt assembly, the male helical cam is subjected to excessive asymmetric loads which, over time, cause it to fail. Another disadvantageous byproduct of the asymmetric loads resulting from the use of a single helical cam system is the tendency toward longitudinal centerline misalignment of the bolt head and the bolt body, which causes the firing pin to strike the primer of the cartridge off center. This periodically results in late detonation or complete failure of detonation of loaded cartridges. Failure of detonation results in live ammunition being discarded and causes the gun to run rough. The likely result of late detonation is severe jamming of the gun.

It would therefore be advantageous to provide a machine gun in which malfunctions due to component breakage are reduced by reducing the asymmetric forces acting on the male helical cam. It would also be advantageous to provide such a gun in which the firing pin strikes the center of the cartridge primer with higher accuracy and consistency than in previous designs, to thereby prevent late detonation or total failure of detonation at all of the cartridge.

These and other advantages are provided in accordance with the illustrated embodiment of the present invention by incorporating a second male helical cam to the bolt head, opposite the existing male helical cam. Correspondingly, a second female helical cam is positioned in the bolt body, opposite the existing female helical cam, for receiving the second male helical cam. The combination of the second male and female helical cams forms a second helical cam system. In addition to the second helical cam system, a bearing pads are added to the bottom of the bolt head to support the bolt head, under certain circumstances, in the chamber area of the forward portion of the rotor. More specifically, the bearing pads provide a positive means for ensuring proper alignment of the bolt head to the bolt body, in turn ensuring proper alignment of the firing pin with the center of the primer. Under normal circumstances, the combination of the two helical cam systems will provide the desired alignment of the firing pin and primer. However, in the case of excessive wear of the bolt assembly, for example, the bearing pads will come in contact with and be supported by the chamber area of the rotor to ensure that the centerline of the bolt head will remain within an acceptable range.

DETAILED DESCRIPTION OF THE PREFERRED EMBODIMENT

Figure 1:
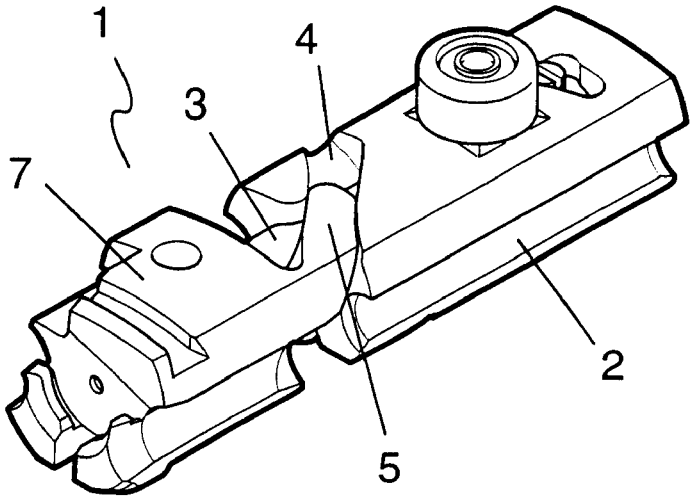
FIG. 1 is front perspective diagram of a machine gun bolt assembly in accordance with the present invention.
Figure 2:
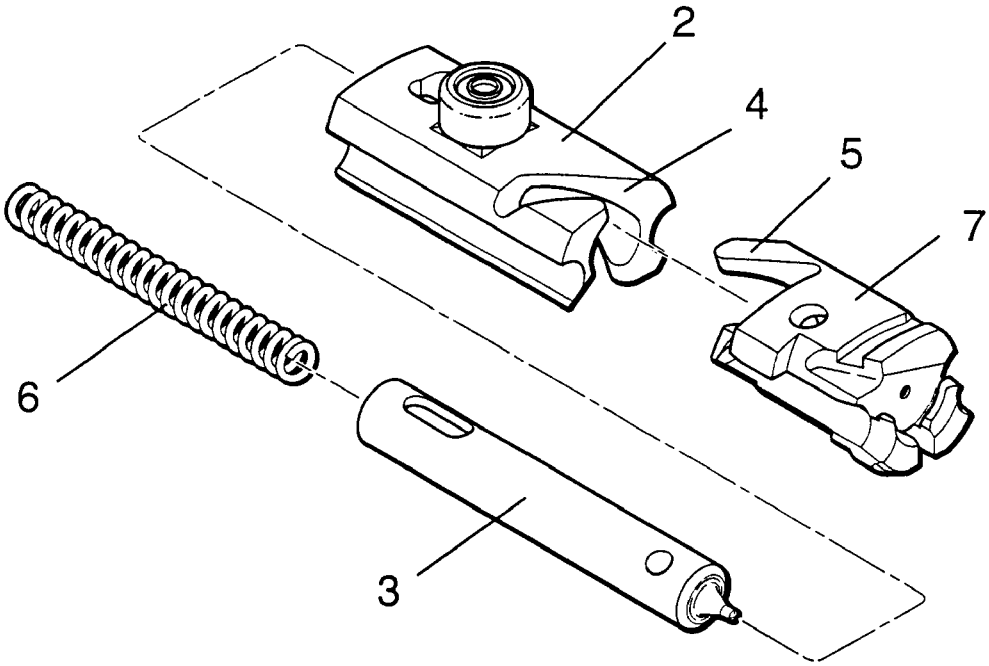
FIG. 2 is an exploded diagram of the bolt assembly of FIG. 1, showing the individual components thereof.
Figure 3:
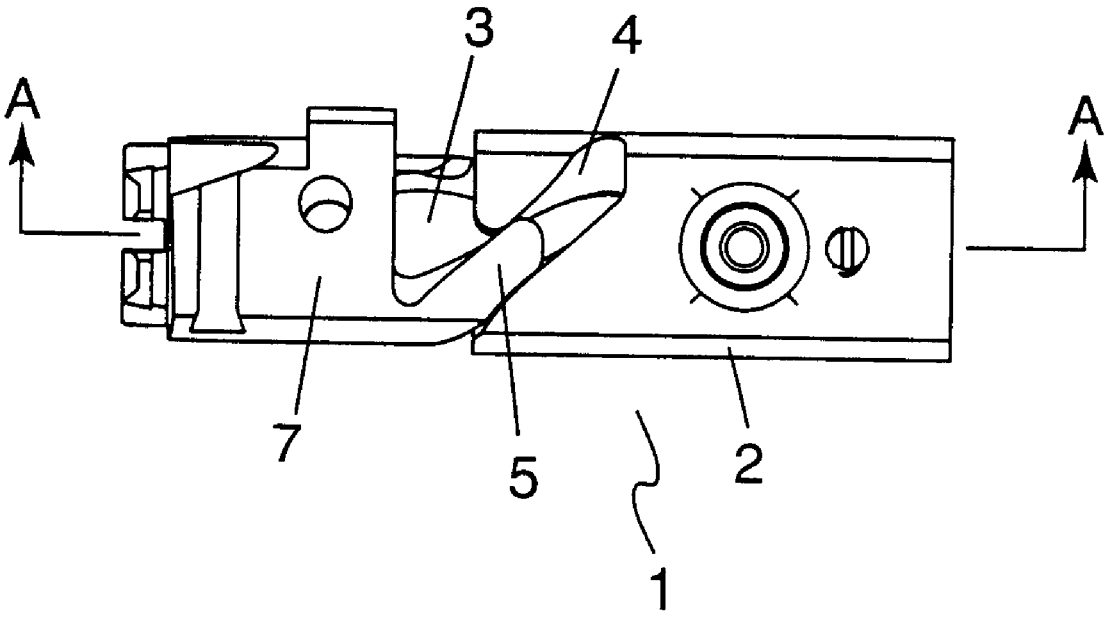
FIG. 3 is a top plan view of the bolt assembly of FIG. 1.
Figure 4:
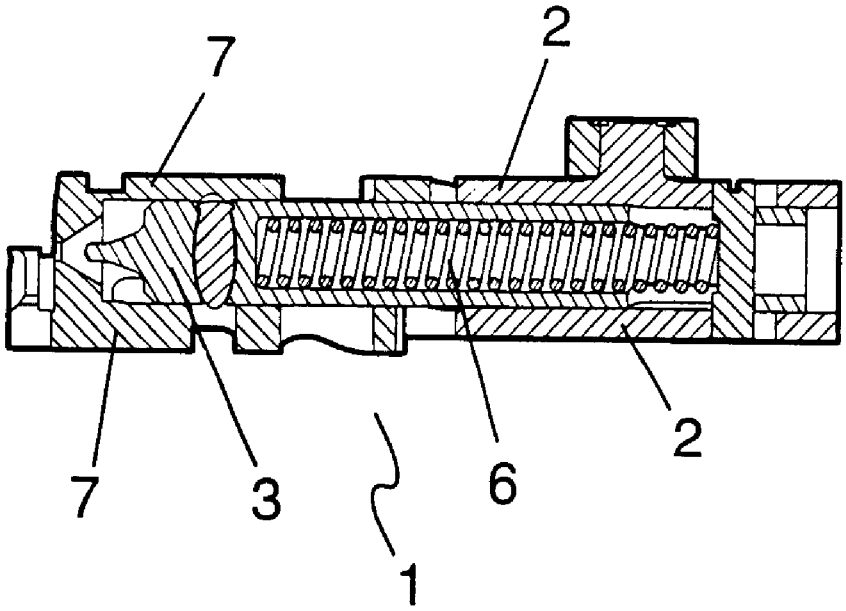
FIG. 4 is a sectional view of the bolt assembly of FIG. 3, taken along the section line A—A thereof.

Referring now generally to FIGS. 1–4, there is shown a bolt assembly 1 of a machine gun constructed in accordance with the present invention. Bolt assembly 1 conventionally includes a bolt head 7, a bolt body 2, a firing pin 3, a first female helical cam 4, and a first male helical cam 5. The first female and male helical cams 4, 5 form a first helical cam system. The positional relationship of these components is illustrated in the assembly diagram of FIG. 2 and the sectional diagram of FIG. 4, which also show a firing pin spring 6.

Figure 5:
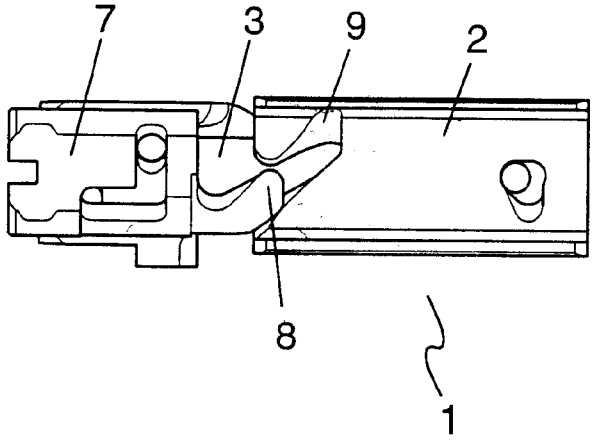
FIG. 5 is a bottom plan view of the bolt assembly of FIG. 1.
Figure 7:
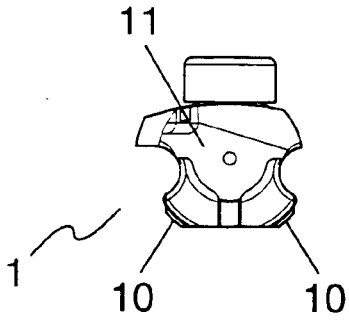
FIG. 7 is a front elevation view of the bolt assembly of FIG. 1.
Figure 6:
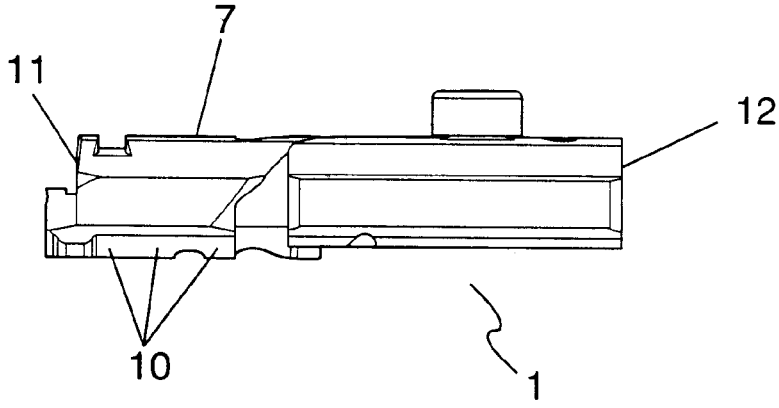
FIG. 6 is right elevation view of the bolt assembly of FIG. 1.

Referring now to FIG. 5, there are shown a second male helical cam 8 and a second female helical cam 9 that together form a second helical cam system within bolt assembly 1. As illustrated in FIGS. 6 and 7, bearing pads 10 are positioned on both the left and right bottom surfaces of bolt head 7.

Figure 8:
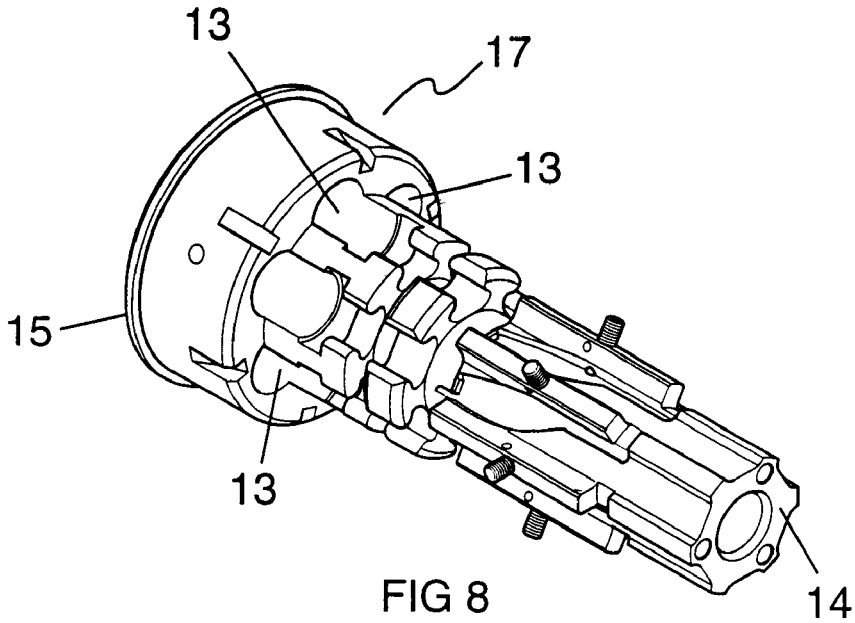
FIG. 8 is a rear perspective view of the rotor employed in the machine gun of the present invention.
Figure 9:
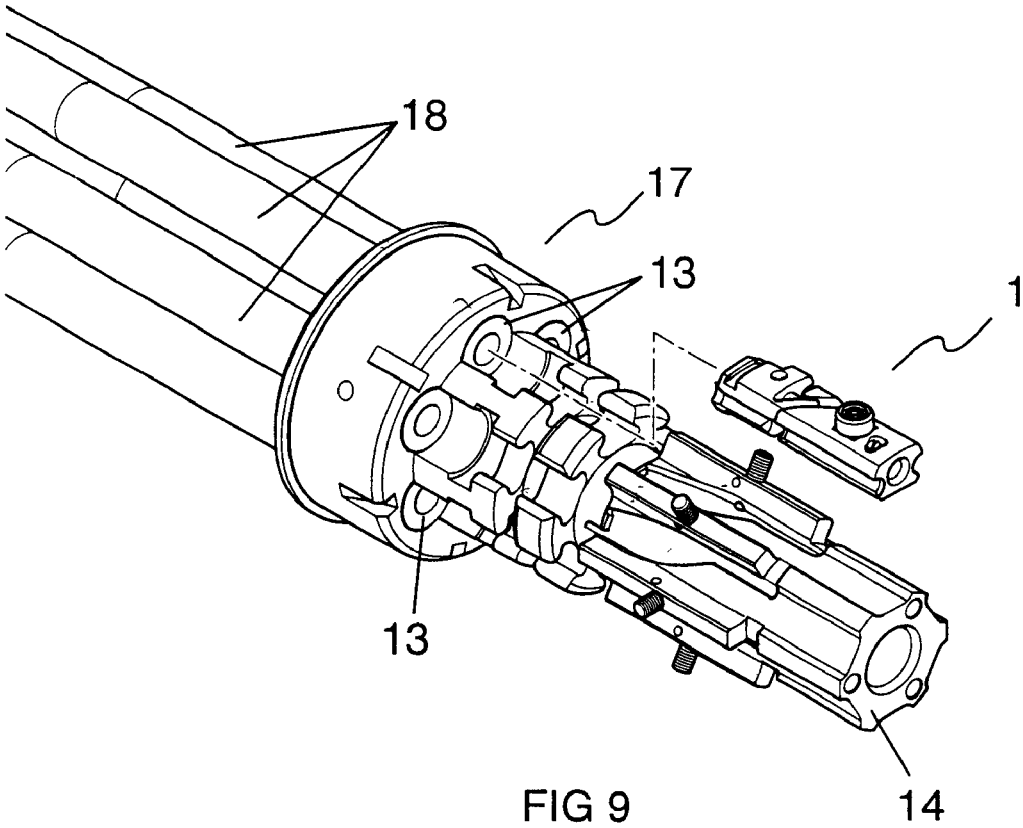
FIG. 9 is a rear perspective view of the machine gun of the present invention, including barrels, the bolt assembly of FIG. 1, and the rotor of FIG. 8.
Figure 10:
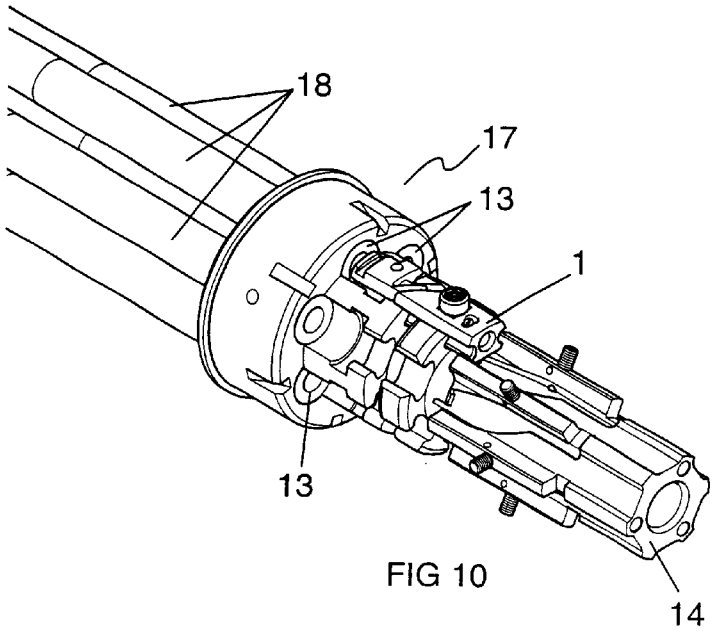
FIG. 10 is rear perspective view of the machine gun of FIG. 9, showing the assembled components thereof.

Referring now to FIG. 8, there is shown a conventional machine gun rotor 17 having a rear face 14 and a front face 15 and that includes six chamber areas 13. FIGS. 9 and 10 illustrate the positional relationship between six barrels 18, attached to the front face 15 of rotor 17, six chamber areas 13, and a representative one of the bolt assemblies 1.

Figure 11:
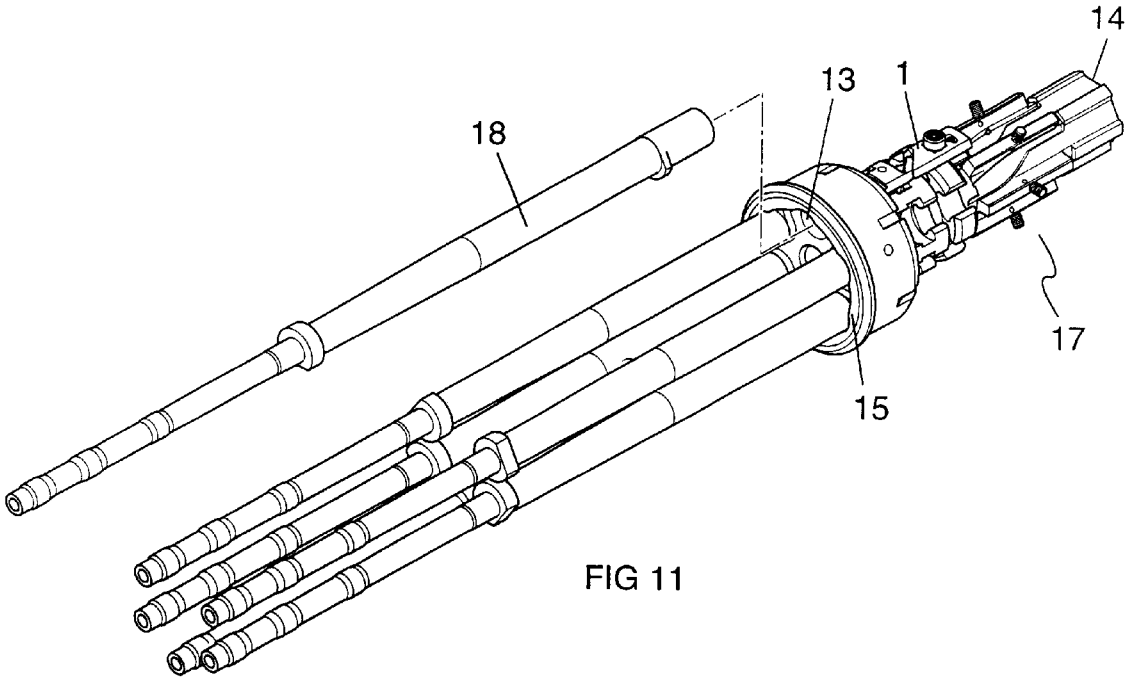
FIG. 11 is a front perspective view of the machine gun of FIG. 10.
Figure 12:
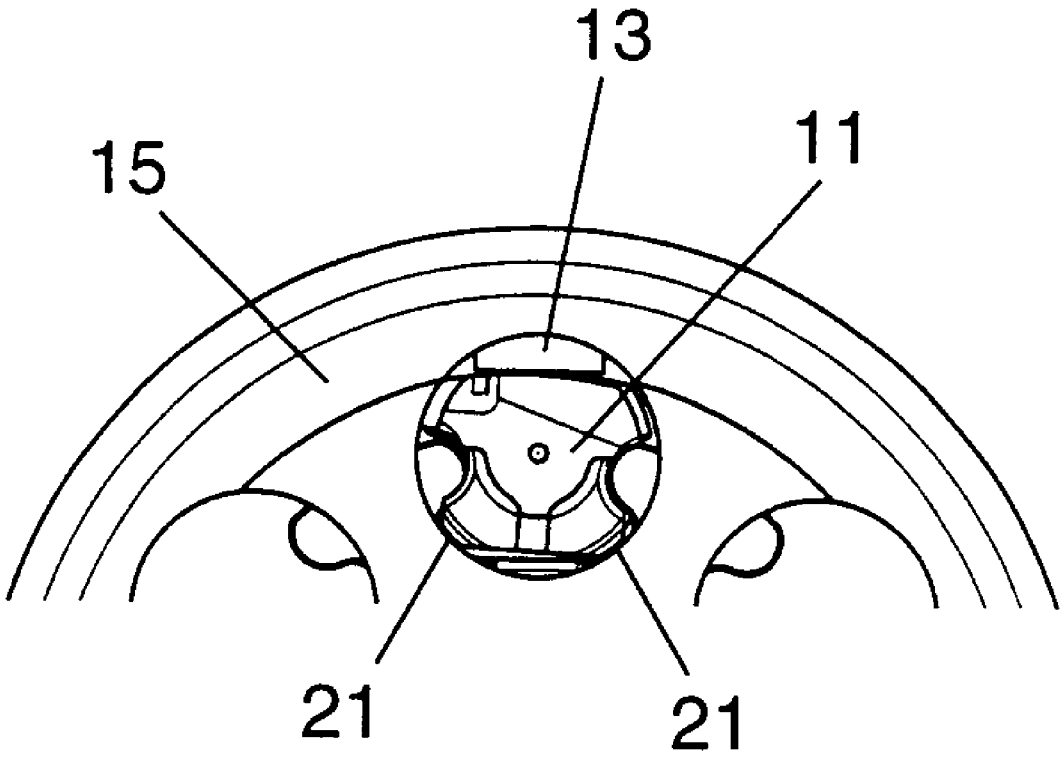
FIG. 12 is an enlarged front elevation view of the assembled rotor illustrated in FIG. 10.

Referring now to FIG. 11, there is shown the machine gun of the present invention in which one of the barrels 18 has been removed from rotor 17 to better illustrate one of the chamber areas 13, as viewed from the front face 15 of rotor 17. FIG. 12 is an enlarged view of the front of one of the chamber areas 13 showing a front face 11 of bolt head 7 and the bearing pads 10 in contact with the inner surface of that chamber area 13.

I claim:

1. A machine gun comprising:

a rotationally driven rotor having a plurality of cylindrical chambers formed therein;

a like plurality of barrels attached to a front surface of said rotor in alignment with corresponding ones of said chambers; and a like plurality of bolt assemblies positioned in respective ones of said chambers, each of said bolt assemblies comprising a forward bolt head and a rearward bolt body, each of said bolt assemblies comprising first and second helical cam systems, each of said first and second helical cam systems comprising a male helical cam formed in said bolt head and a female helical cam formed in said bolt body.

2. A machine gun as in claim 1, wherein each of said first helical cam systems is formed in a top portion of corresponding ones of said bolt assemblies and each of said second helical cam systems is formed in a bottom portion of corresponding ones of said bolt assemblies.

3. A machine gun as in claim 1, further comprising one or more bearing pads attached to each of said bolt assemblies and positioned for contacting an inner surface of corresponding ones of said chambers.

4. A machine gun as in claim 3, wherein said one or more bearing pads are attached to a bottom portion of each of said bolt heads.

* * * * *